US006839030B2

(12) United States Patent
Noujeim

(10) Patent No.: US 6,839,030 B2
(45) Date of Patent: Jan. 4, 2005

(54) LEAKY WAVE MICROSTRIP ANTENNA WITH A PRESCRIBABLE PATTERN

(75) Inventor: Karam Michael Noujeim, Sunnyvale, CA (US)

(73) Assignee: Anritsu Company, Morgan Hill, CA (US)

( * ) Notice: Subject to any disclaimer, the term of this patent is extended or adjusted under 35 U.S.C. 154(b) by 7 days.

(21) Appl. No.: 10/439,197

(22) Filed: May 15, 2003

(65) Prior Publication Data

US 2004/0227664 A1 Nov. 18, 2004

(51) Int. Cl.[7] ..... H01Q 1/38
(52) U.S. Cl. ..... 343/700 MS; 343/785
(58) Field of Search ..... 343/700 MS, 772, 343/785; 333/237, 238, 239

(56) References Cited

U.S. PATENT DOCUMENTS 5,448,252 A * 9/1995 Ali et al. ..... 343/700 MS
6,005,520 A * 12/1999 Nalbandian et al. . 343/700 MS
6,285,325 B1 * 9/2001 Nalbandian et al. . 343/700 MS
6,489,930 B2 * 12/2002 Teshirogi et al. ..... 343/785

OTHER PUBLICATIONS

Wolfgang Menzel, *A New Traveling–Wave Antenna in Microstrip*, AEU, Band 33, Apr. 1979 pp. 137–140.
S.V. Zaitsev and A.T. Fialkovskii, *Edge Effects in Strip Structures with an Arbitrary Grazing Angle of the Wave. Waves in a Microstrip Waveguide*, Radiofizika, vol. 24, No. 9, pp. 786–791.
A.A. Oliner and K. S. Lee, *The Nature of the Leakage from Higher Modes on Microstrip Line*, IEEE MTT–S Digest, 1986, pp. 57–60.
I. J. Bahl and Prakash Bhartia, *Leaky–Wave Antennas Using Artificial Dielectrics at Millimeter Wave Frequencies*, IEEE Transactions on Microwave Theory and Techniques, vol. MTT–28, No. 11, Nov. 1980, pp. 1205–1212.
Heshmatollah Maheri, Makoto Tsutsumi and Nobuaki Kumagai, *Experimental Studies of Magnetically Scannable Leaky–Wave Antennas Having a Corrugated Ferrite Slab/Dielectric Layer Structure*, IEEE Transactions on Antennas And Propagation, vol. AP–36, No. 7, Jul. 1988, pp. 911–917.
Orest Vendik, Igor Mironenko and Leon Ter–Martirosyan, *Superconductors Spur Application of Ferroelectric Films*, Microwaves and RF, vol. 33, No. 7, Jul. 1994, pp. 67–70.

(List continued on next page.)

*Primary Examiner*—Hoang V. Nguyen
(74) *Attorney, Agent, or Firm*—Fliesler Meyer LLP

(57) ABSTRACT

A system and method for prescribing an amplitude distribution to a leaky-wave microstrip antenna having an array of radiating cells. The leaky-wave microstrip antenna includes a grounded element, a dielectric member coupled to the grounded element and a top conducting strip coupled to the dielectric member, the conducting strip including a first and second non-radiating conducting strip and a plurality of radiating cells. This distribution requires that the microstrip antenna possess a variable leakage-constant profile along its length, and is chosen so as to yield an H-plane power-gain pattern having low sidelobes. The leakage-constant profile is achieved by configuring the width and inter-cell spacing of the antenna radiating cells and keeping the phase constant fixed. The length or loading of the radiating cells may also be manipulated to achieve the desired leakage constant profile. This results in the desired distribution along the antenna's aperture and yields a power-gain pattern with low sidelobes. The antenna is excited by two equal-amplitude and 180° out-of-phase signals. These signals are applied to the feed end of the microstrip at two feeding ports. The microstrip antenna length is chosen such that more than 97% of the input power is radiated by the traveling electromagnetic, wave, while the remaining power is absorbed by the resistively terminated antenna end.

15 Claims, 11 Drawing Sheets

OTHER PUBLICATIONS

R. E. Horn, H. Jacobs, K. L. Klohn and E. Freibergs, *Single–Frequency Electronic–Modulated Analog Line Scanning Using a Dielectric Antenna*, IEEE Transactions on Microwave Theory and Techniques, vol. MTT–30, No. 5 May 1982, pp. 816–820.

S. V. Zaitsev and A. T. Fialkovskii, *Edge Effects in Strip Structures With on Arbitrary Grazing Angle of The Wave. Waves in a Microstrip Waveguide*, Radio Phys. Quant. Electron, vol. 24, No. 9, Sep., 1981, pp. 786–791.

Wolfgang Menzel, *A New Travelling–Wave Antenna in Microstrip*, AEU, vol. 33, No. 4, Apr. 1979, pp. 137–140.

A. A. Oliner and K. S. Lee, *The Nature of the Leakage from Higher Modes on Microstrip Line*, 1986 IEEE MTT–S Digest, Baltimore, MD, Jun. 2–4, 1986, pp. 57–60.

* cited by examiner

LEAKY WAVE MICROSTRIP ANTENNA WITH A PRESCRIBABLE PATTERN

REFERENCE TO RELATED APPLICATIONS

The present application is related to the following United States Patents and Patent Applications, which patents/applications are assigned to the owner of the present invention, and which patents/applications are incorporated by reference herein in their entirety:

U.S. Pat. application No. 10/600,293, entitled "FIXED-FREQUENCY BEAM-STEERABLE LEAKY-WAVE MICROSTRIP ANTENNA", filed on 20 Jun. 2003, currently pending.

FIELD OF THE INVENTION

The current invention relates generally to leaky wave antennas, and more particularly to leaky-wave microstrip antennas having a prescribable power pattern.

BACKGROUND OF THE INVENTION

Leaky wave antennas are electromagnetic traveling-wave radiators receiving a feed signal at one end and terminated in a resistive load at the other. The feeding end is used to launch a wave that travels along the antenna while leaking energy into free space. Power remaining in the traveling wave as it reaches the antenna end is absorbed by the resistive load. Using a single feed signal to excite a leaky-wave antenna results in higher radiation efficiency than in a microstrip antenna array. This is because microstrip antenna arrays suffer from spurious radiation and ohmic losses associated with their corporate feed. The aforementioned features of leaky-wave antennas make them well suited for operation at high frequencies.

In 1979, Menzel introduced a traveling-wave microstrip antenna based on the first higher-order mode ($EH_1$) (W. Menzel, "A new traveling-wave antenna in microstrip", Arch. Elektron. Ubertragungstech., vol. 33, no. 4, pp. 137–140, April 1979). The antenna was asymmetrically fed by means of a microstrip line as shown in FIG. 1*a* and FIG. 1*b*. Transverse slots located along the center line of the antenna were used to suppress the fundamental mode. Using a quarter-wave transformer, the input impedance of the antenna was matched to the characteristic impedance of the microstrip feed line. The antenna radiated an x-polarized main beam at an angle $\theta=37.5°$ away from broadside (the z direction). The antenna exhibited an impedance bandwidth broader than that of the resonant microstrip patch, but also produced a high backlobe level.

Oliner and Lee later disclosed that the microstrip antenna introduced by Menzel could be operated as a leaky-wave antenna had it been configured to be 4.85 $\lambda_0$ long instead of 2.23 $\lambda_0$, where $\lambda_0$ is the free space wavelength at the design frequency (A. Oliner and K. S. Lee, "The Nature of the Leakage from Higher Modes on Microstrip Line", 1986 IEEE International Microswave Symposium Digest, and "Microstrip Leaky-Wave Strip Antennas", 1986 IEEE International Antennas and Propagation Symposium Digest). They also disclosed that Menzel's antenna exhibits a high backlobe level because 35% of the incident power is reflected at the terminated end, with the backlobe appearing at the same angle as the main beam when measured from the broadside. A three-dimensional view of Oliner and Lee's leaky-wave microstrip antenna is shown in FIG. 2.

The amplitude of the x-directed current traveling along the aforementioned leaky-wave microstrip antenna is shown in FIG. 3*a*. It is an exponentially decaying distribution that results in the x-polarized H-plane power-gain pattern shown in FIG. 3*b*. This pattern exhibits sidelobes that appear at ~12 dB below the main beam, and are undesirable in applications such as radar since they result in false-target identification. What is needed is an efficient leaky-wave microstrip antenna having high gain and low side lobes.

SUMMARY OF THE INVENTION

The present invention addresses the limitations and disadvantages of the prior art by introducing a leaky-wave microstrip antenna to which an aperture distribution may be prescribed. This distribution requires that the antenna possess a variable leakage-constant profile along its length, and is chosen so as to yield an H-plane power-gain pattern having low sidelobes (<<12 db below the main beam). The leakage-constant profile is achieved by choosing appropriately the width and length of the antenna's radiating cells, while keeping the phase constant fixed. This results in the desired distribution along the antenna's aperture, and thus yields a low-sidelobe power-gain pattern. The antenna is excited by means of two equal-amplitude and 180° out-of-phase signals. These signals are applied to the feed end of the microstrip at two ports. The microstrip antenna length is chosen such that more than 97% of the input power is radiated by the traveling electromagnetic wave, while the remaining power is absorbed by the resistively terminated antenna end.

DETAILED DESCRIPTION

An amplitude distribution may be prescribed to a leaky-wave antenna having a periodical radiator cell structure. This distribution requires that the antenna possess a variable leakage-constant profile along its length, and is chosen so as to yield an H-plane power-gain pattern having low sidelobes. The leakage-constant profile is achieved by configuring the width and length of the antenna radiating cells while keeping the phase constant fixed. The length or loading of the radiating cells may also be manipulated to achieve the desired leakage constant profile. This results in the desired amplitude distribution along the antenna's aperture and yields a low-sidelobe power-gain pattern. The antenna is excited by two equal-amplitude and 180° out-of-phase signals. These signals are applied to the feed end of the microstrip at two feeding ports. The microstrip antenna length is chosen such that more than 97% of the input power is radiated by the traveling electromagnetic wave, while the remaining power is absorbed by the resistively terminated antenna end.

Figure 1A:
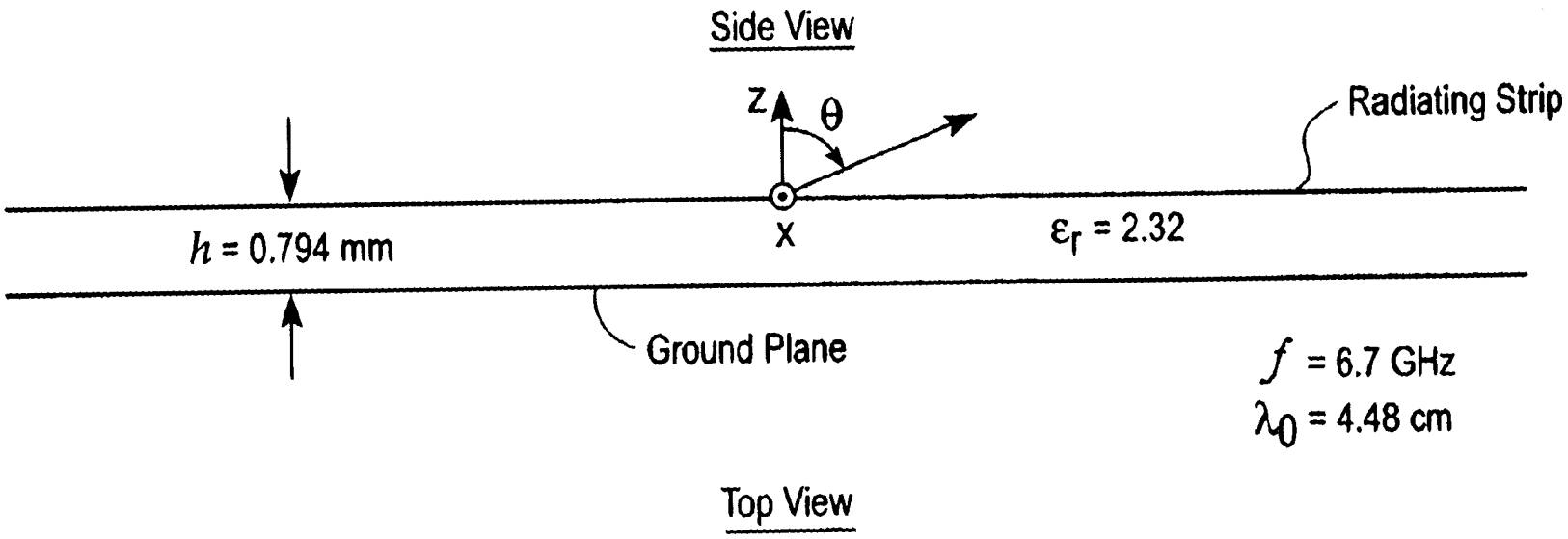
FIG. 1A (PRIOR ART)
FIG. 1*a* is an illustration of a side view of traveling-wave microstrip antenna of the prior art.
Figure 1B:
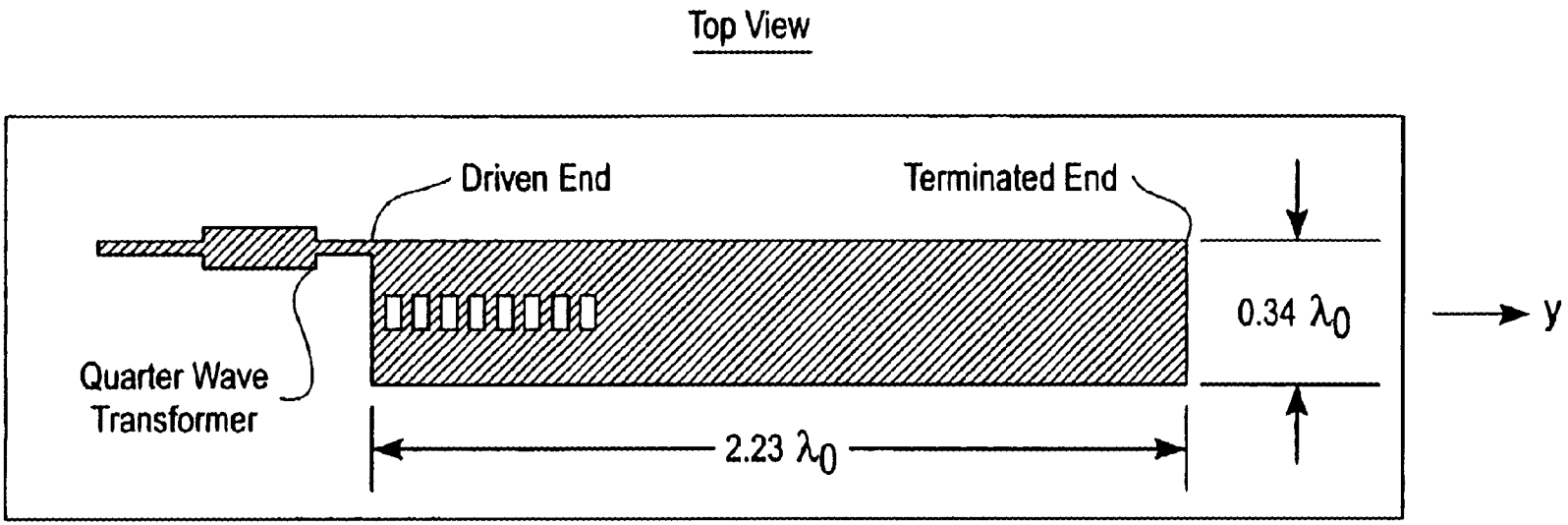
FIG. 1B (PRIOR ART)
FIG. 1*b* is an illustration of a top view of traveling-wave microstrip antenna of the prior art.
Figure 2:
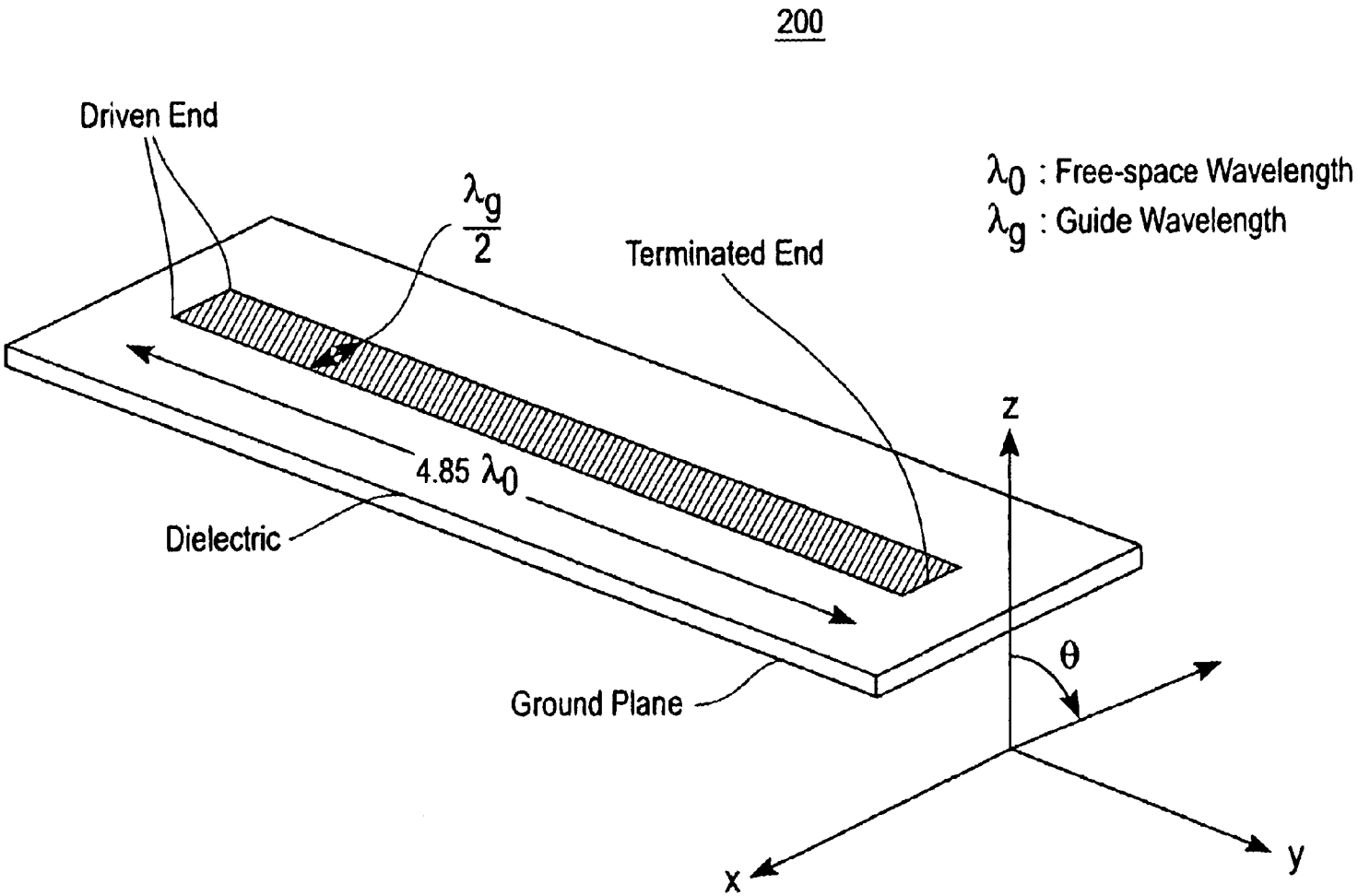
FIG. 2 (PRIOR ART)
FIG. 2 is an illustration of a microstrip leaky-wave antenna of the prior art.
Figure 3A:
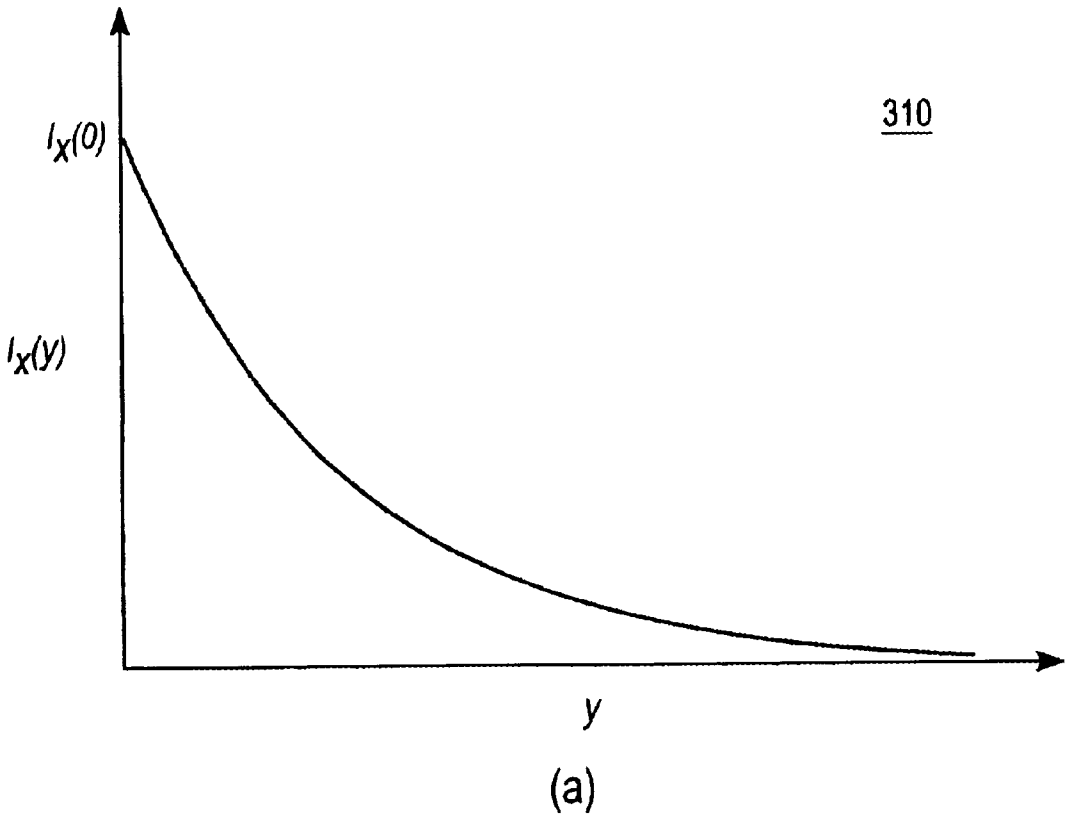
FIG. 3a (PRIOR ART)
FIG. 3*a* is an illustration of a power amplitude distribution of a leaky-wave antenna of the prior art.
Figure 3B:
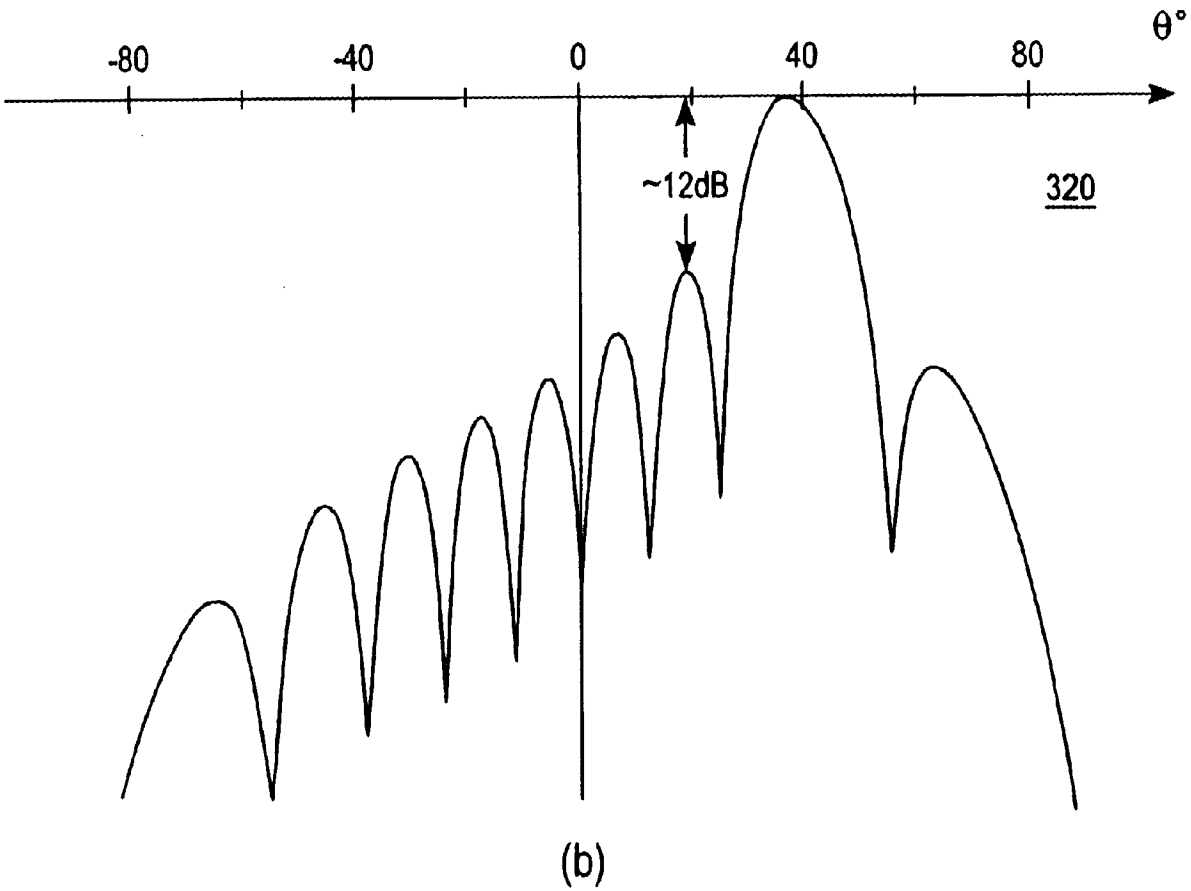
FIG. 3b (PRIOR ART)
FIG. 3*b* is an illustration of the power gain pattern of a leaky-wave antenna of the prior art.
Figure 4:
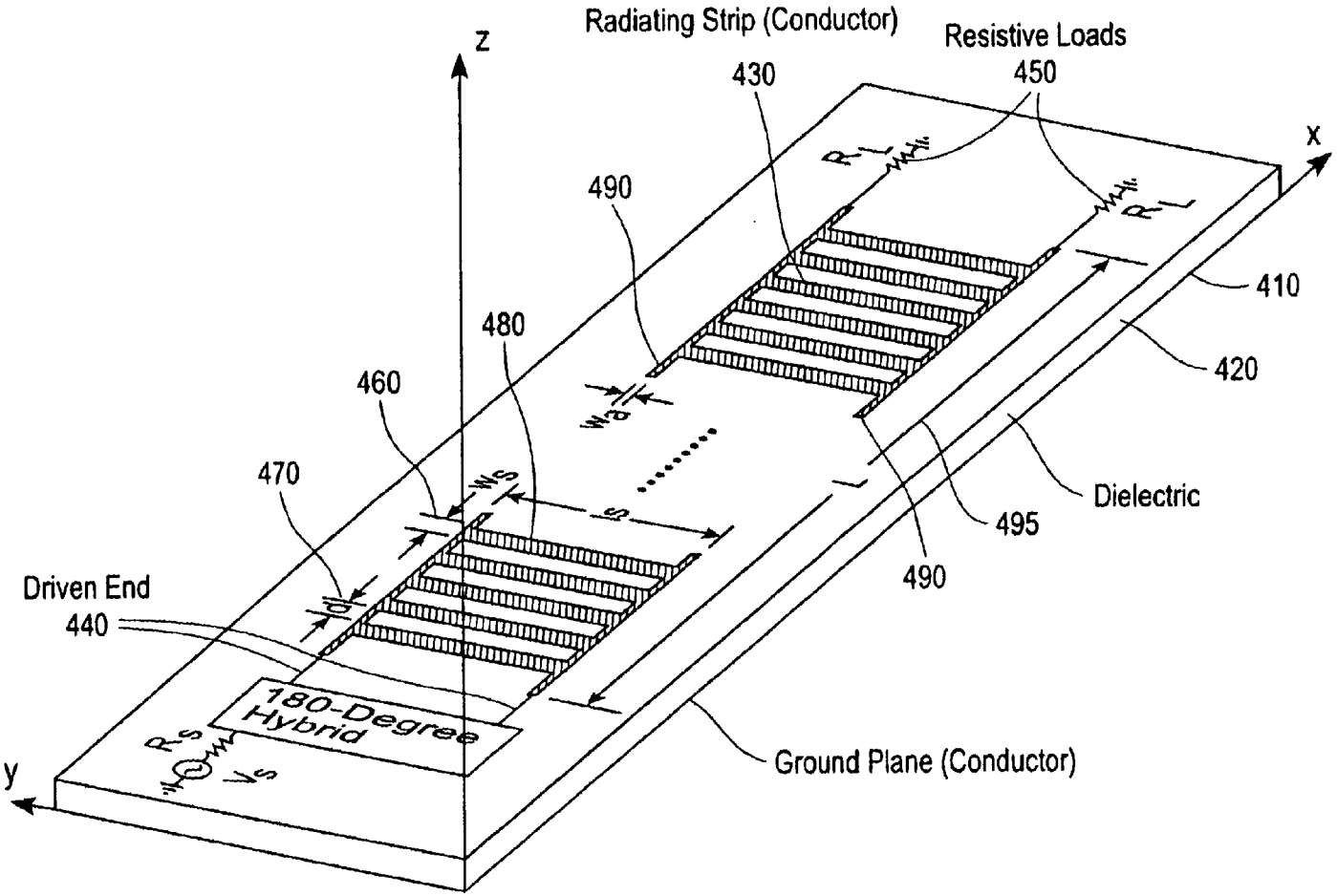
FIG. 4 is an illustration of a periodic structure for a leaky-wave microstrip antenna in accordance with one embodiment of the present invention.

In one embodiment of the present invention, a leaky-wave microstrip antenna is configured to include a periodic structure of radiating conducting cells. A leaky-wave antenna 400 with a periodic structure of radiation cells in accordance with one embodiment of the present invention is shown in FIG. 4. As shown, antenna 400 includes a ground plane 410 coupled to a first side of a dielectric 420. A conducting strip 430 is coupled to a second side of the dielectric slab. The strip is comprised of a periodic structure of radiating cells. Each cell in the periodic structure has a width $w_S$ 460, is separated by an inter-cell spacing d 470, and has a length $l_S$ 480. The cells are connected by symmetric conducting non-radiating strips 490 having a width of $w_a$. The periodic structure of conducting radiator cells is driven by a 180° hybrid at driving end 440 and terminated by resistive loads 450. The length 495 of the two non-radiating strips is given by L. The length of the microstrip is configured such that most of the input power is radiated by the traveling electromagnetic wave while the remaining power is absorbed by the resistively terminated antenna end.

In one embodiment of the present invention, the leakage constant of a leaky-wave microstrip antenna having a periodic conducting radiator cell may be manipulated by reducing the cell width $w_S$ and increasing the inter-cell spacing d. Thus, in the periodic structure of radiating cells, the width and inter-cell spacing of the radiator cells may not be uniform.

A reduction in the width of the radiating cell is accompanied by a decrease in the phase velocity v along the antenna. This decrease in phase velocity may be countered in at least two ways. First, the cell length $l_S$ may be reduced. Second, the cells may be center-loaded with a load device having an impedance. In one embodiment, the load device has a reactance. Neither reducing the cell length $l_S$ nor center-loading the cells will significantly affect the leakage constant. By manipulating the radiating cells in this manner, periodic structures of radiation cells may be used as a fundamental building block in the synthesis of aperture distributions.

A leaky-wave antenna with preferred characteristics may be derived from an amplitude distribution $l_x(y)$. In one embodiment of the present invention, prescribing an amplitude distribution $l_x(y)$ to the aperture of a leaky-wave microstrip antenna of length L requires that the leakage constant $\alpha(y)$ vary along the length of the antenna and that the phase constant $\beta(y)$ remain constant over the length of the antenna. In one embodiment, the leakage constant $\alpha(y)$ along the length of the antenna may vary with respect to the amplitude distribution according to:

$$a(y) = \frac{0.5|I_x(y)|^2}{\int_0^L |I_x(y)|^2\,dy + \frac{P(l)}{P(0)-P(L)}\int_0^L |I_x(y)|^2\,dy} \tag{1}$$

where P(0) is the power available at the feeding end of the antenna, and P(L) is the power remaining in the traveling electromagnetic wave at the antenna's terminated end at y=L. Once the amplitude distribution $l_x(y)$ is known, the x-polarized H-plane power-gain pattern that results from the amplitude distribution may be obtained by considering the leaky-wave antenna as a line source of length L.

For purposes of illustration, a sample amplitude distribution will now be discussed. Consider the amplitude distribution 510 shown in FIG. 5*a*. The amplitude distribution shows $l_x(Y)$ as a function of y along the length L of a leaky-wave microstrip antenna, up to $L=15\lambda_0$, where $\lambda_0$ is the free space wavelength of the signal driving the leaky-wave antenna. The amplitude distribution $l_x(y)$ shown in FIG. 5*a* may be expressed as:

$$I_x(y) = \sqrt{1-\cos\left(\frac{2\pi y}{L}\right)}\sqrt{1-\frac{0.85}{2\pi}\left(\frac{2\pi y}{L}-\sin\left(\frac{2\pi y}{L}\right)\right)} \tag{2}$$

The leakage constant profile over the length L of the antenna may be derived from equation (1) using the value of $l_x(y)$ in equation (2). The derived leakage constant profile 520 over the length of the antenna is illustrated in FIG. 5*b*. As shown in the FIG. 5*b*, the leakage constant profile is for a length of $L=15\lambda_0$), where $\lambda_0$ is the free space wavelength of the signal driving the leaky-wave microstrip antenna.

Figure 6:
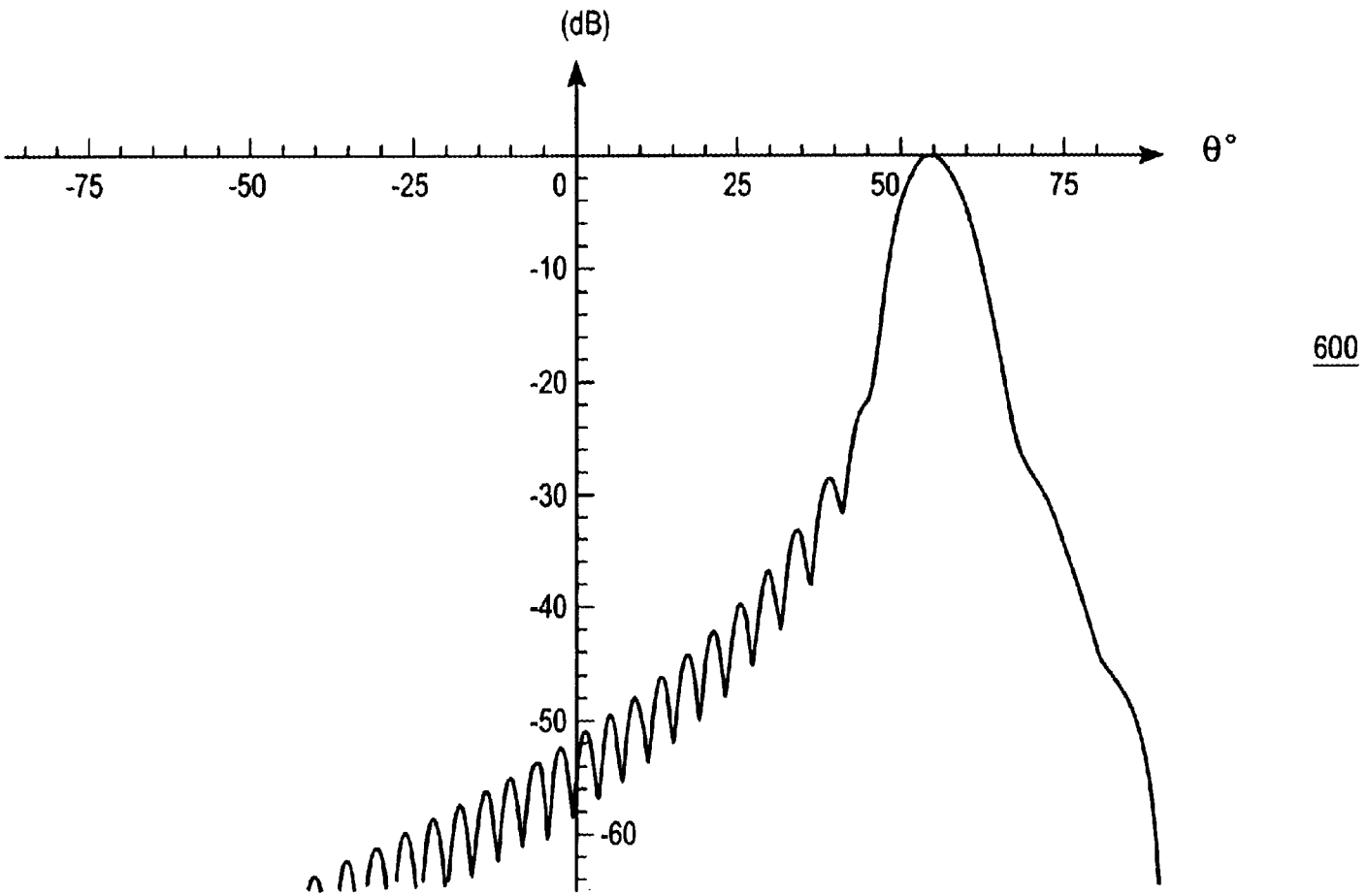
FIG. 6 is an illustration of the power-gain pattern of a leaky-wave microstrip antenna in one embodiment of the present invention.

When treating the leaky-wave microstrip antenna as a line source of length $L=15\lambda_0$, where $\lambda_0$ is the free space wavelength, the x-polarized H-plane power-gain pattern results as illustrated in FIG. 6. The power gain has a main beam occurring at an angle θ of about 55°, and a first side lobe occurring at about 40°. As illustrated in FIG. 6, the sidelobes of the resulting power-gain pattern are at least 27 dB below the main beam. In this example, the element pattern is an x-directed infinitesimal current element lying on a grounded dielectric slab of infinite extent (such as that of a microstrip) having a relative dielectric constant $\epsilon_r=3.78$, and a thickness h=254 micrometers.

Figure 5A:
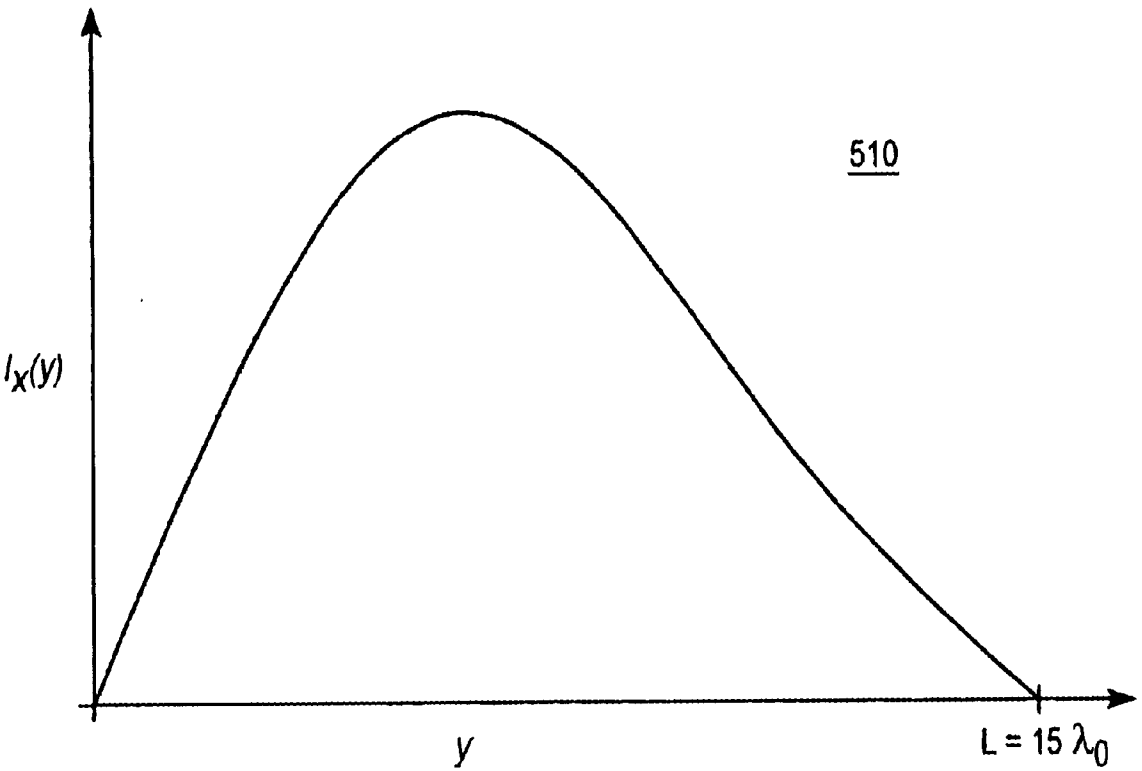
FIG. 5*a* is an illustration of a power amplitude distribution of a leaky-wave microstrip antenna in one embodiment of the present invention.
Figure 5B:
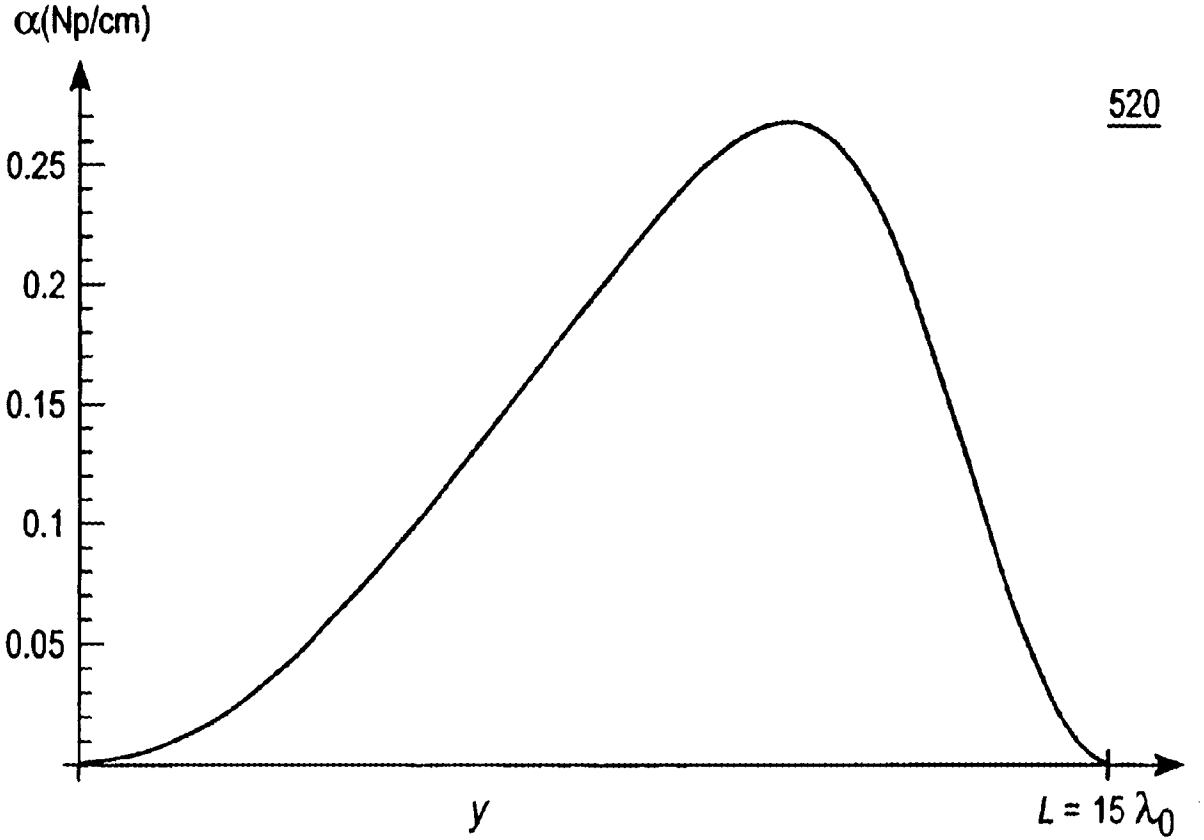
FIG. 5*b* is an illustration of the leakage constant distribution in one embodiment of the present invention.
Figure 7:
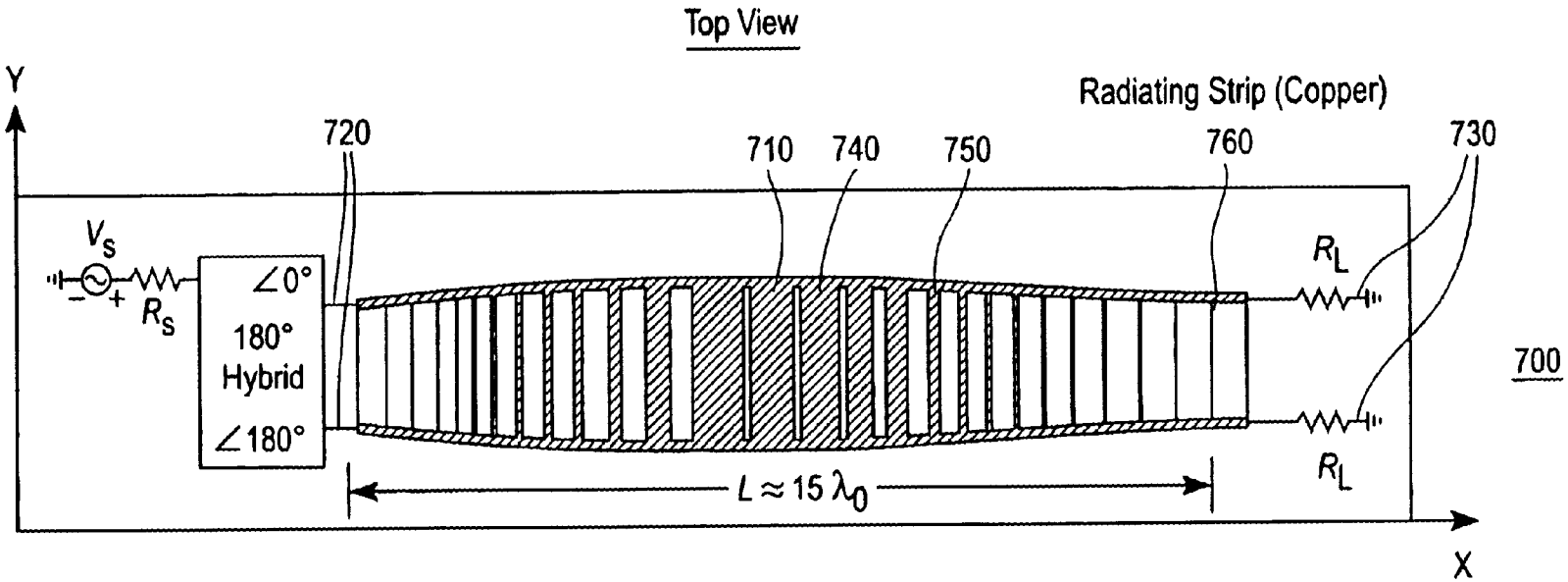
FIG. 7 is an illustration of a top view of a leaky-wave microstrip antenna in accordance with one embodiment of the present invention.

In one embodiment of the present invention, implementation of the leaky-wave microstrip antenna characterized by FIGS. 5*a*, 5*b* and 6 is carried out using conducting radiator cells of non-uniform length, width and inter-strip spacing. A leaky-wave antenna 700 of this embodiment is illustrated in FIG. 7. Leaky wave antenna 700 includes radiating microstrip 710, the microstrip having driving ends 720 and terminated ends connected to resistive loads 730. The radiating microstrip includes a plurality of radiating cells, including cells 740, 750 and 760 which are located at different points along the antenna of length L. The radiating cell 740 is wider and longer than the radiating cell 750. The radiating cell 750 is wider and longer than the radiating cell 760. The inter-cell spacing distance d increases from cell 740 to cell 750 and from cell 750 to cell 760. For the power distribution profile and leakage constant profile across an antenna, the power distribution and leakage constant decrease as the radiating cell width and length decreases and the radiating cell inter-cell spacing increases.

Figure 8:
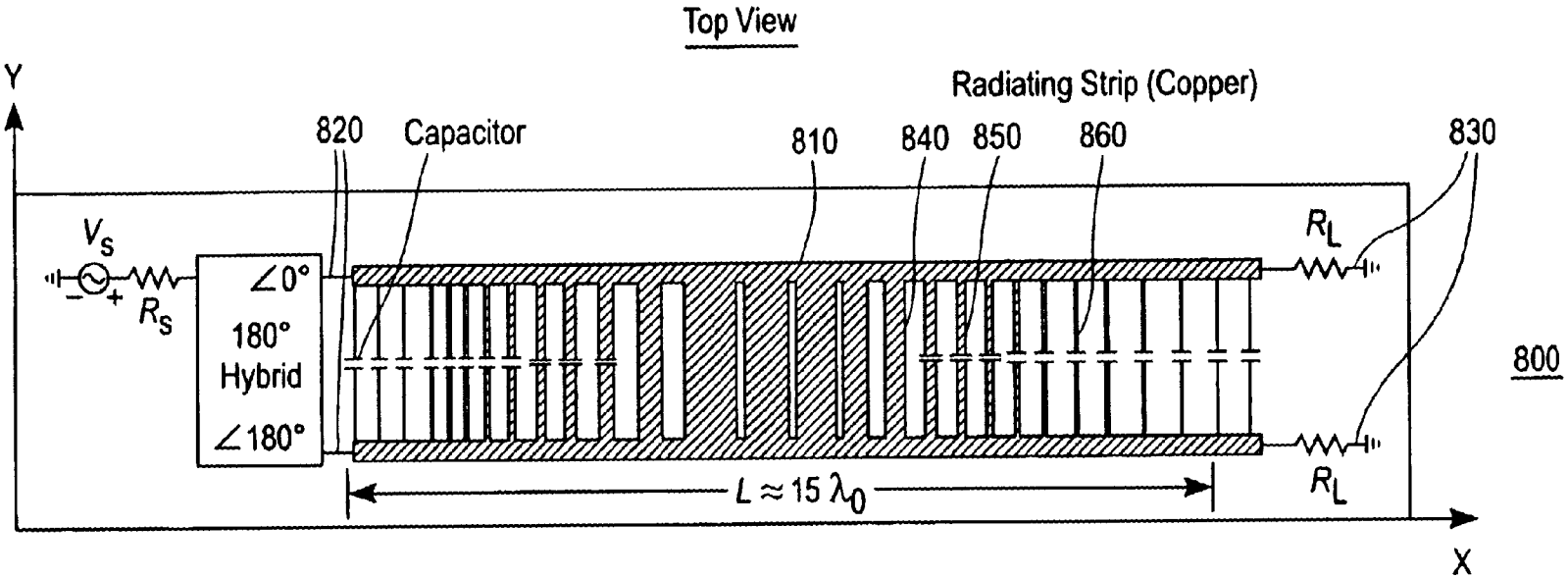
FIG. 8 is an illustration of a top view of a loaded leaky-wave microstrip antenna in accordance with one embodiment of the present invention.

In another embodiment, implementation of the leaky-wave antenna characterized by FIGS. 5*a*, 5*b* and 6 may be carried out using conductor radiator cells that include a load device. The load device has a reactance value that may be configured according to the particular application. In one embodiment, the load device may be a capacitor. In another embodiment, the load device may be an inductor. The load device has an impedance and, in one embodiment, is located at the center of the radiating cell. A leaky wave antenna 800 of this embodiment is illustrated in FIG. 8. As shown in FIG. 8, leaky-wave antenna 800 includes conducting strip 810, the strip having driving ends 820 and terminated ends connected to load resistances 830. Radiating strip 810 includes a plurality of radiating cells, including cells 840, 850 and 860, which are located at different locations along microstrip 810. Cell 840 is closest to the center of, the strip and has no load device. Cell 850 is further away from the center of the strip, is loaded with a capacitor, and has a larger inter-cell spacing and smaller cell width than cell 840. Cell 860 is further away from the center of the strip than cell 850, is center loaded with a capacitor, and has a larger inter-cell spacing and smaller cell width than strip 850. Though pictured with capacitors, the radiating cells may be loaded with any device having an impedance.

An amplitude distribution may be prescribed to a leaky-wave antenna having a periodical radiator microstrip structure. This distribution requires that the antenna possess a variable leakage-constant profile along its length, and is chosen so as to yield an H-plane power-gain pattern having low sidelobes. The leakage-constant profile is achieved by configuring the width and length of the antenna radiating cells and keeping the phase constant fixed. The length or loading of the radiating cells may also be manipulated to achieve the desired leakage constant profile. This results in the desired distribution along the antenna's aperture and yields a low-sidelobe power-gain pattern. The antenna is excited by two equal-amplitude and 180° out-of-phase signals. These signals are applied to the feed end of the microstrip at two feeding ports. The microstrip antenna length is chosen such that more than 97% of the input power is radiated by the traveling electromagnetic wave, while the remaining power is absorbed by the resistively terminated antenna end.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Obviously, many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A leaky wave microstrip antenna comprising:

a grounded element;

a dielectric member coupled to the grounded element; and a conducting strip coupled to the dielectric member, the conducting strip including:

a first non-radiating conducting strip;

a second non-radiating conducting strip; and a plurality of radiating cells, each of the plurality of cells having a generally uniform width and separated by a generally uniform inter-cell spacing, each cell including:

a first end, the first end coupled to said first non-radiating conducting strip; and a second end, the second end coupled to said second non-radiating conducting strip.

2. The leaky-wave microstrip antenna of claim 1 wherein the conducting strip is driven by a pair of 180 degree out of phase driving signals.

3. The leaky-wave microstrip antenna of claim 1 wherein the conducting strip is connected to resistance loads.

4. The leaky-wave microstrip antenna of claim 1 wherein at least one of the plurality of radiating cells has a different generally uniform width from at least one other of the plurality of radiating cells.

5. The leaky-wave microstrip antenna of claim 1 wherein at least one of the plurality of radiating cells has a different generally uniform inter-cell spacing from at least one other of the plurality of radiating cells.

6. The leaky-wave microstrip antenna of claim 5 wherein the conducting microstrip is coupled to a resistive load.

7. The leaky-wave microstrip antenna of claim 1 wherein at least one of the plurality of radiating cells has a different length from at least one other of the plurality of radiating cells.

8. The leaky-wave microstrip antenna of claim 7 wherein the plurality of radiating cells includes a first cell located at a point along the length of the antenna where the power distribution is at a maximum and a second cell located at a point along the length of the antenna where the power distribution is at less than the maximum, the length of the first cell longer than the length of the second cell.

9. The leaky-wave microstrip antenna of claim 7 wherein each of the plurality of radiating cells is located at a particular location along the leaky-wave microstrip antenna, the length of each of the plurality of radiating cells being generally proportional to the power distribution associated with the particular location along the leaky-wave microstrip antenna.

10. The leaky-wave microstrip antenna of claim 1 wherein at least one of the plurality of radiating cells includes a load device having an impedance.

11. The leaky-wave microstrip antenna of claim 10, wherein the load device is located approximately at the center of the radiating cell.

12. The leaky-wave microstrip antenna of claim 10 wherein the load device is a capacitor.

13. The leaky-wave microstrip antenna of claim 10 wherein each of the plurality of radiating cells is located at a particular location along the leaky wave antenna, the width of each of the plurality of radiating cells being generally proportional to the power distribution associated with the particular location along the leaky wave antenna.

14. The leaky-wave microstrip antenna of claim 13 wherein a first cell at a first location along the length of the leaky wave antenna is associated with a first amount of power dissipation, a second cell at a second location along the length of the leaky wave antenna is associated with a second amount of power dissipation, the first amount of power dissipation higher than the second amount of power dissipation, the first cell width lower than the second cell width.

15. The leaky-wave microstrip antenna of claim 1 wherein the conducting microstrip is driven by a first driving signal and a second driving signal, the first and second driving signal being 180 degrees out of phase.

* * * * *